United States Patent [19]

Hunt

[11] 4,195,730

[45] Apr. 1, 1980

[54] CONTAINER HAVING SEPARATE STORAGE FACILITIES FOR TWO MATERIALS

[75] Inventor: Guilbert M. Hunt, Brecksville, Ohio

[73] Assignee: General Foods Corporation, White Plains, N.Y.

[21] Appl. No.: 917,324

[22] Filed: Jun. 20, 1978

[51] Int. Cl.[2] ..... B65D 39/08; B65D 81/32

[52] U.S. Cl. ..... 206/221; 206/222; 215/270; 215/DIG. 8

[58] Field of Search ..... 128/272.1; 206/219–222, 568; 215/6, 208, 223, 227, 250, DIG. 8, 260, 270; 220/258, 329, 23; 366/602

[56] References Cited

U.S. PATENT DOCUMENTS

| | | | |
|---|---|---|---|
| 2,793,776 | 5/1957 | Lipari | 215/DIG. 8 |
| 3,220,588 | 11/1965 | Lipari | 206/222 |
| 3,326,400 | 6/1967 | Hamelin et al. | 215/DIG. 8 |
| 3,347,410 | 10/1967 | Schwartzman | 206/222 X |
| 3,613,955 | 10/1971 | Wetherell, Jr. | 215/DIG. 8 |
| 3,720,524 | 3/1973 | Nakagami | 206/222 X |
| 3,968,872 | 7/1976 | Cavazza | 206/222 |

FOREIGN PATENT DOCUMENTS

| | | | |
|---|---|---|---|
| 570276 | 12/1957 | Italy | 206/222 |
| 1383404 | 2/1975 | United Kingdom | 206/222 |

*Primary Examiner*—Stephen Marcus
*Attorney, Agent, or Firm*—Daniel J. Donovan; Bruno P. Struzzi

[57] ABSTRACT

A container providing for the separate storage of two materials and the automatic admixing of the materials upon opening of the container. A main container holds a quantity of a first material, such as carbonated water, and a separate compartment holds a small quantity of a second material, such as dipeptide flavoring. In a first embodiment of the invention, a compartmented closure of the twist-on, twist-off type is mounted on the neck of a bottle-shaped container. The closure includes a compartment extending into the container neck, having a hinged bottom closure with a lip which protrudes radially outwardly below the bottle neck. As the closure is unscrewed from the bottle, the lip engages the interior of the bottle neck, causing the hinged bottom to open and thereby release the second material into the main container. In a second embodiment of the invention, a bottle has a twist-on, twist-off type closure which has a compartment for the second material therein. The compartment is stationarily positioned in the neck of the bottle, and the closure includes a movable piercing element which, upon unscrewing of the closure, pierces the stationary compartment to cause the release of the second material into the bottle.

5 Claims, 6 Drawing Figures

CONTAINER HAVING SEPARATE STORAGE FACILITIES FOR TWO MATERIALS

BACKGROUND OF THE INVENTION

1. Field of the Invention

The present invention relates, in general, to containers and, more particularly, pertains to containers having separate compartments in which several ingredients of a product may be stored separately until it is desired to admix them, at which time it is possible to establish communication between the compartments so that the separated ingredients may be admixed prior to dispensing of the product from the containers.

Containers of this type are useful for the separate storage of ingredients or materials for a variety of products, and have particular applicability to the fields of pharmaceuticals and cosmetics, for instance, where at least two ingredients can be stored separately for reasonably lengthy periods of time, but if admixed will produce a product which deteriorates rather rapidly. Such products usually, but not necessarily, comprise at least one liquid ingredient and at least one other ingredient which may be either in the form of a liquid or be in the form of dry granules or powder.

Other fields of application in which such containers may find utility are in the separate storage and pre-dispensing addition of color pigments to paints, the admixing of catalysts and chemical compounds (e.g., epoxy cements), and the combination of different chemicals in order to produce desired reactions (e.g., multicomponent foam systems), for instance, the addition of dyes utilized in the coloring of foods.

Another important field of use for containers of this type lies in the storage of foodstuffs and particularly beverages. Thus, a new flavoring constituted of dry ingredients, and being in the form of granular material or a powder may have been developed for carbonated beverages which has significantly higher potential consumer appeal in comparison with existing products, with the beverage, however, having a limited shelf-life after the flavoring is mixed with carbonated water present in the container. The flavoring has a lengthier shelf-life when maintained in a dry condition and separate from the water or liquid, and with the product being more flavorful and marketable when stored in a container which maintains the flavoring and carbonated water in separate compartments and inaccessible to each other until opening of the container for the purpose of dispensing the beverage.

2. Discussion of the Prior Art

At present, the prior art discloses various containers or receptacles for the separate storage of various materials or ingredients of a product adapted to be admixed prior to dispensing from the containers.

Nosik U.S. Pat. No. 2,721,522; Bowes et al U.S. Pat. No. 3,156,369; Magni U.S. Pat. No. 3,603,469 and Lanfranconi et al U.S. Pat. No. 3,840,136 each disclose multi-compartmented containers for the separate storing and admixing of various materials. Each of these patents discloses a type of container in the shape of a bottle or the like wherein a frangible member is adapted to be severed or ruptured by the depression of a plunger so as to dispense a material stored in a compartment within the neck of the bottle into a liquid which is located in the bottle. However, severance of the frangible member is caused by depression of the plunger in the prior art patents, and not by a simple upward or rotational movement of a closure for the bottle or container as is contemplated by the present invention. Moreover, inadvertent or even deliverate severance of the frangible member is frequently encountered when the containers are tampered with in a retail store, for instance, by children or adults.

SUMMARY OF THE INVENTION

Accordingly, the present invention contemplates the provision of an improved and unique container for separately storing several materials or ingredients of a product prior to opening of the container and which, upon opening of the container, automatically and practically instantaneously causes the separately stored materials to be admixed prior to being dispensed from the container.

In accordance with a preferred embodiment of the invention, there is disclosed an arrangement for separately storing first and second materials in a container, and which is adapted to effect admixing of the separately stored materials upon opening of the container and prior to being dispensed therefrom. The arrangement includes a container for storing the first material, which container has an access aperture to allow access to its contents. Preferably, the container comprises a necked bottle in which the access aperture is a pouring orifice formed in the end of the bottle neck. A closure member is provided for sealingly closing the aperture, and has a closed compartment therein for holding the second material separated from the first material. The closure is responsive to rotational movements thereof relative to the container to effect release of the second material from the compartment in which it is stored into the first material in the container and to thereby cause admixing of the materials.

In one embodiment of the invention, the container includes a threaded section extending about the access aperture, or bottle neck, onto which there is threaded a twist-on, twist-off closure member, for instance, of the bottle cap type. The container portion, or bottle neck, which includes the access or dispensing orifice, has an internally hollow, preferably cylindrical section which communicates with the interior of the container storing the first material which, preferably, is of a liquid nature. The closure member which is basically of the bottle cap type having an internally threaded flanged portion which threadingly engages the threaded section on the container so as to seal the aperture or bottle neck orifice, as is well known in the art, includes a hollow cylindrical member depending into the container in close fit with the hollow cylindrical neck portion of the container. Hingedly fastened to the inner or distal end of the cylindrical member is a sealing bottom wall having radially protruding edge or rim portions extending beyond the diametral measurements of the inner hollow cylindrical neck and being located therebelow in the container. This, in essence, will form a closed compartment in which the second material, such as a powder or granular material, is stored. Thus, upon the closure member being threaded or twisted off the container, the radially protruding edge portion of the hinged sealing wall engages the inside wall surface of the container as the latter faires into its neck portion below the access aperture or dispensing orifice to cause the hinged wall to be pivoted downwardly about its hinged connection with the cylindrical member and thereby release the second material from the compartment into the first material in the container so as to admix therewith. Furthermore, the protruding edge portions in the hinged wall are in the form of two lips with a gap therebetween, and constituted of a resiliently yieldable material so that when the lips are pressed towards each other, the cylindrically-shaped compartment may be readily inserted into the container, with the lips springing apart upon being inserted to a depth in the container below the cylindrical neck portion. In the disclosed embodiment of the invention, the cylindrically shaped compartment of the closure member is provided with a vent slot which extends axially along the outer cylindrical surface of the compartment to allow the pressure within and exteriorly of the container to equalize through the slot as the closure is initially threaded or twisted off the container. Furthermore, in the disclosed embodiment of the invention, the first material in the container may be constituted of carbonated water, and the second material in the compartment of a flavoring for the carbonated water, for example, one which may contain a dipeptide sweetener.

In accordance with a second disclosed embodiment of the invention, the container includes a cylindrical threaded neck section extending about the access aperture, which threaded section is adapted to be engaged by a cap-like twist-on, twist-off closure member. The closure member includes a closed compartment containing the second material which is fixedly mounted relative to the container so as to extend into the container neck, while the twist-off closure member includes a projecting piercing element rotatable therewith and depending into the closed compartment proximate a segment of the inner circumferential wall surface thereof. The piercing element is positioned so as to pierce through the side wall of the compartment as the twist-off closure member is unscrewed from the container so as to release the second material into the first material. In this embodiment of the invention, the piercing element is eccentrically arranged within the fixedly mounted compartment, with the latter being formed of a frangible diaphragm which is internally contacted and ruptured by the piercing element when the twist-off closure member is unscrewed from the container.

Accordingly, it is a primary object of the present invention to provide a novel container for separately storing several materials prior to the opening of the container.

Another object of the present invention is to provide a container of the type described in which the container has a twist-on, twist-off closure member threadedly mounted thereon and with a compartment formed therein for storing one material separately from another material contained in the main portion of the container, and which facilitates the automatic opening of the compartment in the closure member upon unscrewing of the latter from the container.

A more specific object of the present invention lies in the provision of a container of the type described, which is particularly adapted to hold a beverage consisting of carbonated water and of flavoring powder; separately store the constituents by providing a barrier virtually impermeable to water to thereby compartment the container; cause the powder to admix automatically and almost instantaneously with the water when the container is opened; incorporate a convenience type opening; utilize standard size beverage cans or bottles; require little modification of standard closures or containers such that any increase in container cost is minimal; pour easily when opened; not contain loose debris from the barrier after opening of the container; and be compatible with standard carbonated beverage filling and sealing equipment, with the possible exception that special provisions may be required to fill the powder into its compartment in the container.

BRIEF DESCRIPTION OF THE DRAWINGS

The foregoing and other objects and advantages of an inventive container constructed pursuant to the teachings of the present invention may be more readily understood by one skilled in the art, having reference to the following detailed description of the preferred embodiments thereof, taken in conjunction with the accompanying drawings, in which.

DETAILED DESCRIPTION OF THE DRAWINGS

Figure 1:
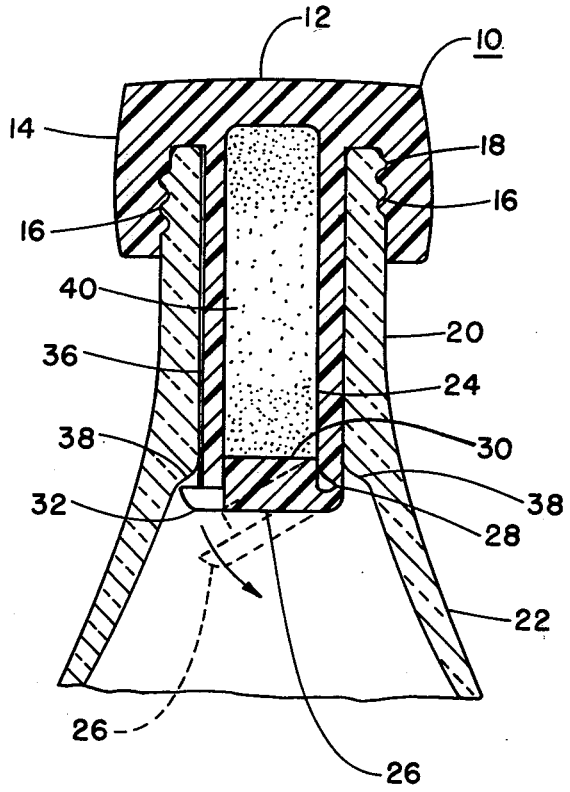
FIG. 1 illustrates a first embodiment of the invention showing the dispensing portion of a container which is provided with a twist-on, twist-off type cap closure incorporating a closed compartment storing a material therein which is automatically opened by unscrewing the closure from the container so as to cause the material to admix with another material in the container.

Referring now in detail to the drawings, in FIG. 1 there is illustrated an elevational cross-sectional view of a container pursuant to a first embodiment of the invention, with the container being in the shape of a bottle having a twist-on, twist-off closure cap 10 fastened thereon. Closure 10 is essentially of standard bottle cap appearance having a generally flat crown portion 12 and an annular flange portion 14 extending downwardly therefrom. The inner circumferential wall of the flange portion 14 is provided with threads 16 which are adapted to cooperate with complementary external threads 18 formed on the neck 20 of a bottle-shaped container 22. The closure cap 10 is formed with a hollow compartment 24 therein, preferably although not necessarily, of cylindrical configuration, in concentric relationship with flange portion 14 and which, when the closure cap is fully threaded onto the container, is positioned in close fit within a hollow cylindrical aperture or orifice defined by the interior of the neck 20 of the container. The cylindrical compartment 24 includes a bottom wall or closure 26 which is hingedly connected to the former by means of a small tab section 28 which joins the bottom wall 26 to the cylindrical wall of the compartment 24. The bottom or closure 26 is shown in more detail in FIG. 2, which is a bottom view thereof.

Bottom closure 26 includes a short, cylindrical plug section 30, as shown in FIG. 1, which extends a short distance into the compartment 24 and whose circumference is dimensioned so as to be in press-fitted engagement with the inner cylindrical wall of the compartment to thereby seal compartment 24 and the contents therein. In a modified embodiment of the invention, the compartment 24 may also be sealed by the use of a suitable adhesive. The outer edge or rim of bottom closure 26 includes a pair of radially projecting lip portions 32 which are separated by a gap 34. The closure cap includes a vent slot 36 which extends axially or longitudinally along the outer cylindrical surface of the cylindrically-shaped compartment 24, and which enables the inside and exterior of the bottle to be equalized in pressure upon opening of the closure cap in a manner as will be explained hereinbelow. The entire closure cap 10, including the thereto hinged bottom closure 26 for the compartment, may be advantageously formed of a single piece of molded plastic material.

The bottle container is formed with an interior which expands in diameter at the juncture of the main bottle section with its neck portion 20 forming a type of internal shoulder 38 as the container opens from the neck portion 20. The bottle may be formed of glass or plastic, and may be a commercially available type of beverage or liquid container.

Figure 2:
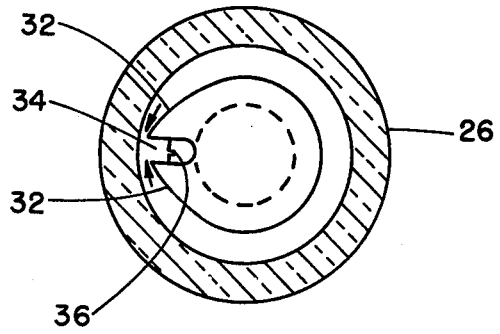
FIG. 2 is a bottom view of the closure illustrated in FIG. 1.

The cylindrical compartment 24 is filled with a material 40 which is adapted to be automatically admixed, upon opening of the container, with another material contained in the main body of the container. Thus, the material or ingredient contained in the main portion of the container or bottle 22 may be carbonated water, and the material stored in the cylindrical compartment 24 may be a flavoring therefor, such as for example dipeptide, in dry powder or granular form. It is desired to store the dipeptide separately from the carbonated water since the dipeptide undergoes a hydrolysis reaction after being mixed with water, which imparts a limited shelf-life to the mixture after mixing thereof. The cylindrical compartment 24 is filled with the powder material and sealed prior to the closure cap 10 being applied to the container. The closure cap 10 is mounted on the container by compressing the lip portions 32 toward each other and into the gap 34 whereby the lip portions do not radially protrude beyond the circumference formed by the outside of the cylindrical compartment. The closure is then inserted into the hollow cylindrical interior of the neck 20 of the container, with the final portion of the insertion being facilitated by twisting of the closure into place so that the threads on the cap and container interengage to draw the inner surface of the crown 12 of the closure cap 10 into intimate and sealing contact with the top surface of the neck 20 thereby sealing the bottle. As the cylindrical compartment 24 is fully inserted into the neck portion, the lip portions 32 pass beyond the neck portion into the expanded diameter section immediately below shoulder 38, at which time the lip sections 32, by being formed of a resiliently yieldable plastic material, will spread apart from their compressed state into the shape illustrated in FIG. 2, in effect, they will project radially outwardly below bottle shoulder 38. As shown in FIGS. 1 and 2, each lip section 32 is a radially outwardly protruding member having an upwardly curved lower surface at its outer extremity which will facilitate insertion thereof into the container, and a flat upper surface which will cause it to engage shoulder 38 as the closure cap 10 is unscrewed so as to cause the bottom closure 26 to be pivoted downwardly about tab section 28.

The dispensing of the admixed materials or ingredients from the container is as follows:

If the container has previously been filled with carbonated water, the pressure within the container prior to opening is normally about five atmospheres. As the closure cap 10 is unscrewed from the neck portion 18 of the container, the initial unscrewing action imparted to the closure cap 10 causes the inner surface of crown 12 of the closure cap to lift off the top surface of the neck 20. This enables any difference in pressure existent between the inside and exterior of the container 22 to be equalized through the vent slot 36 and between threads 16 and 18. Such an equalization of pressure, prior to opening of the compartment 24, is important since if gas were to be vented when the compartment is opened, the vented gas might entrain some of the powder or granular material emptying into container 22 from the compartment, thereby resulting in blowing out of the material to the outside of the container upon opening thereof prior to being admixed with the liquid or carbonated water. As the closure cap 10 is further unscrewed from the container 22, the lip portions 32 come into bearing contact against the bottom of the neck constituted by the shoulder 38. Further unscrewing and resultant upward displacement of the closure cap forces the hinged bottom closure 26 to be pivoted downwardly from the cylindrical container 24 and into a position approximating that illustrated by phantom lines in FIG. 1. This causes the bottom of the cylindrical compartment 24 to be opened, and allows the material or ingredients contained therein to be released into the material in the container 22 so as to be admixed therewith.

The embodiment of the invention shown in FIGS. 1 and 2 evidences a number of advantages over known prior art constructions. Thus, the entire closure cap 10 may be formed of a unitary piece of molded plastic, with material being placed in the cylindrical compartment 24, and the cylindrical plug section 30 applied to seal the compartment before mounting of the closure cap on the container. Compression of the two lip sections 32 into the gap 34 therebetween facilitates the ready insertion of the cylindrical compartment of the closure into the hollow neck of the container. The container may be a standard bottle-type container, and does not have to be modified in any way for use with the closure cap. Release of the contents of the compartment into the container is automatic upon unscrewing of the closure cap from the container. The vent slot enables the pressures inside and exteriorly of the container to be equalized prior to the release of the contents of the cylindrical compartment into the container. The contents of the compartment are released below the neck of the container such that the contents of the container may be directly imbibed without any actual lip contact with residue from the contents of the compartment. Bottom closure 26 is withdrawn from the container 22 along with the closure cap 10, thereby leaving no closure cap particles in the container after opening of the latter. The closure cap is remountable on the container in the event that the entire contents of the container are not consumed at one time.

Figure 3:
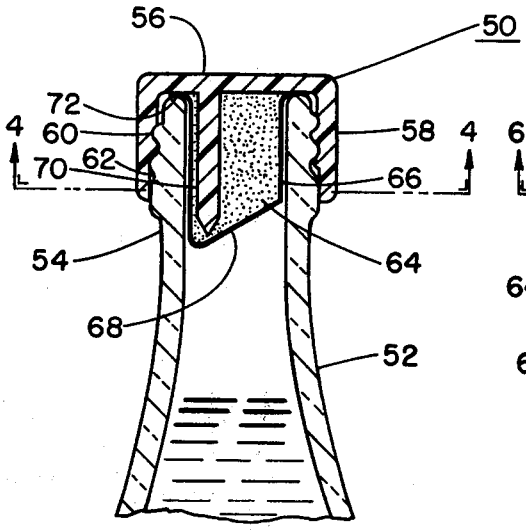
FIG. 3 illustrates a second embodiment of the invention wherein a container is provided with a twist-on, twist-off type cap closure, and with the container having a separate compartment therein for storing a material which is adapted to be ruptured open upon unscrewing of the closure so as to cause the material to admix with the contents of the container.

Referring to FIG. 3, there is illustrated a second embodiment of the present invention wherein the container closure is a twist-on, twist-off type closure cap 50, and unscrewing thereof causes the rupture of a separate closed compartment fixedly supported in the container.

Figure 5:
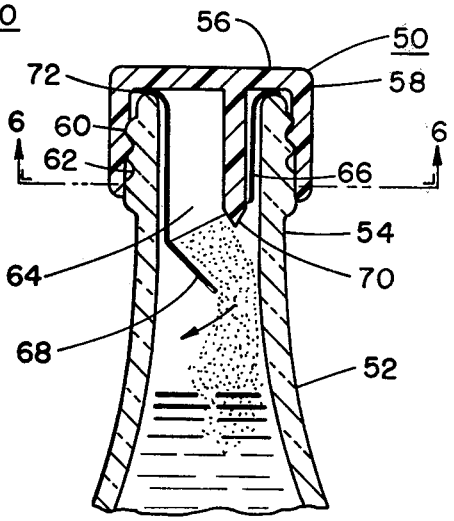
FIG. 5 is an elevational sectional view of the embodiment of the invention illustrated in FIG. 3, showing the rupturing action of the piercing element after the closure is partially unscrewed.
Figure 4:
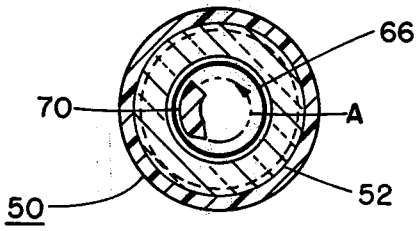
FIG. 4 illustrates a bottom view of the position of a piercing element of the cap closure for rupturing the compartment, as shown in FIG. 3 prior to unscrewing of the closure.
Figure 6:
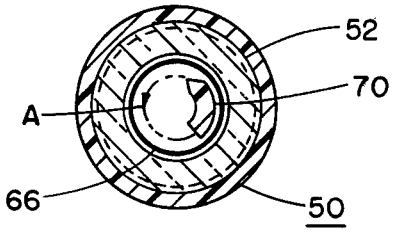
FIG. 6 is a bottom view of the position of the piercing element in FIG. 5.

The closure cap 50 seals a bottle-shaped container 52 having a neck portion 54. The bottle may be a standard, commercially available bottle formed of glass or plastic. The closure cap 50 includes a crown 56 and an internally threaded annular flange 58 depending from the crown 56. The interior of flange 58 includes a threaded section 60 which is adapted to threadingly cooperate with a complementary externally threaded section 62 formed proximate the upper end of the neck portion 54 of the container 52. The container 52 includes a compartment 64 sealingly fastened to the rim of the neck portion 54 and extends into the neck portion of the container 52. The compartment 64 is defined by a cylindrical wall 66 which closely follows the inner wall of neck portion 54 and a flat oblique bottom wall 68. A piercing element 70 in the form of an arcuately curved plate extends down into the compartment from the crown 56 of the closure cap 50. Piercing element 70 is located eccentrically within the compartment 64 and in the closed condition of the closure cap 50 depends into proximity with the lowermost bottom portion of the compartment. The unscrewing of the closure cap causes the piercing element 70 to rotate along the path shown by arrow "A". The closure cap comprised of the crown 56, the flange 58, and the piercing element 70 may be formed of a single piece of molded plastic. The compartment 64, and particularly the oblique bottom wall 68 of the compartment, may be formed of a type of material, such as a thin metallic foil, which is easily rupturable when the piercing element 70 is moved into contact therewith. Alternatively, the bottom wall 68, or the entire compartment 64, may be formed of a thin sheet of plastic or suitable frangible material. The material forming the compartment extends up to and covers over the rim of neck portion 54, and is sealingly clamped between the crown 56 of the closure cap 50 and the rim of neck portion 54. The material adheres to the neck of the container so as to remain stationary when the closure cap 50 is unscrewed. This seal 72 on the rim of neck portion 54 may be of an intermittent or discontinuous construction so that, as the closure cap is unscrewed from the container but before the piercing element 70 moves into rupturing contact with the compartment wall 68, portions of the seal 72 will open to allow for venting and an equalization between the pressures present inside and exteriorly of the container. When the container 52 contains carbonated water, the internal pressure is approximately five atmospheres, and the seal 72 allows gas to escape through the intermittent unsealed portions thereof upon unthreading of closure cap 50 prior to wall 68 being ruptured, so that the escaping gas from the container does not entrain any material stored in the compartment 64. FIGS. 5 and 6 show the position of the piercing element 70 after it has ruptured wall 68 to allow the material stored in the compartment 64 to flow out and admix with the material in the container 52.

In assembling the closure cap 50, container 52 and compartment 64; after filling of the last-mentioned with material, the compartment is adhered at its upper rim or annular edge to the inner annular edge surface of crown 56. The reason for this is, that when the closure cap 50 is threaded onto the container 52 after initial filling, the compartment 64 must be prevented from rotation relative to the closure cap 50 in order to avoid the piercing element 70 from rupturing the compartment. Thereafter, the use of a stronger seal between the compartment and the rim of the container neck portion 54 will cause the former to adhere to the container when the closure cap 50 is subsequently unthreaded from the container.

If desired, the rupturable wall 68 of the compartment may be of a hinged bottom closure construction attached to a generally rigid cylindrical wall of the compartment. The compartment may be opened to dispense its contents into the container when the piercing element biases the bottom closure downwardly responsive to rotation of the closure cap on the container.

While several embodiments of the present invention have been disclosed, the teachings of the present invention as set forth herein will suggest many alternative embodiments to those skilled in the art. For instance, although containers for only two separately stored materials are shown and described in the disclosed embodiments, it should be apparent that embodiments may be designed in which three or more materials may be stored separately and automatically admixed upon opening of the container.

What is claimed is:

1. A container arrangement for separately storing at least first and second materials and for admixing said materials responsive to opening of said container arrangement, comprising:

a. a container for containing said first material, said container including a dispensing orifice defining an access aperture to the contents of the container, a threaded neck section extending about said access aperture, and an enlarged inner diameter section communicating with said neck section;

b. closure means for said access aperture, said closure means being a threaded closure cap engageable with said threaded neck section for screwing onto or off said container, a compartment associated with said closure means for containing said second material, said compartment extending through said neck section into the enlarged diameter section of said container, said compartment including a hinged end wall portion for normally closing an opening communicating the interior of said compartment with said container, and said closure means including means for releasing the second material from said compartment into the first material in the container responsive to rotational movement of said closure means relative to said container, including said hinged wall portion being located in said enlarged diameter container section and having a radially protruding extension projecting into said container section beyond the radial dimensions of the neck section thereof, said radially protruding extension comprising two resiliently yieldable lip portions having a gap therebetween, said lip portions being bendable towards each other into said gap to facilitate said compartment being inserted into the neck of the container and to spread apart in said enlarged diameter section thereof upon sealing of said container with said closure cap whereby, responsive to unscrewing of said closure cap from said container, said extension will engage the inner wall surface of said neck portion so as to pivot said hinged wall portion and release the material in said compartment into the material in said container.

2. An arrangement as claimed in claim 1, said compartment including a longitudinally extending vent slot formed in the outer cylindrical surface thereof along the length of said compartment, said vent slot facilitating equalization of the pressure within and externally of said container upon commencing the opening of said closure means and preceding opening of said compartment.

3. A container arrangement for separately storing at least first and second materials and for admixing said materials responsive to opening of said container arrangement, comprising:

a. a container for containing said first material, said container including a dispensing orifice defining an access aperture to the contents of the container, a threaded neck section extending about said access aperture, and an enlarged inner diameter section communicating with said neck section; and b. closure means for said access aperture including a threaded closure cap engaging said threaded neck section for screwing onto or off said container, a substantially cylindrically shaped compartment associated with said closure means for containing said second material, said compartment being formed of a frangible material and depending into said container neck section, said compartment also having its upper edge fastened to the rim of said container neck section so as to be stationary relative to said container, said upper edge of the compartment being intermittently fastened to the rim of said container neck section to provide vent apertures equalizing the pressure within and externally of said container responsive to unscrewing of said closure means, the other end of said compartment within said container being an oblique end wall relative to said neck section, and said closure means including means for releasing the second material from said compartment into the first material in the container responsive to rotational movement of said closure means relative to said container, including a piercing element fastened to said closure cap for rotation therewith, said piercing element extending into said compartment and being eccentrically offset from the axis of rotation of said closure cap whereby rotation of said closure cap through a predetermined angle for opening said container causes said piercing member to rupture said oblique end wall of said compartment releasing the material contained therein into the material contained in said container.

4. An arrangement as claimed in claim 3, said closure cap and said piercing element being of a unitary integral structure.

5. An arrangement as claimed in claim 3, said piercing element comprising a plate member depending from said closure cap into said compartment, said plate member being generally arcuate in cross-section.

* * * * *